United States Patent [19]

Weinert

[11] 4,446,636

[45] May 8, 1984

[54] OCEANIC MINING SYSTEM

[76] Inventor: Friedrich Weinert, 219-19-131 Ave., Jamaica, N.Y. 11413

[21] Appl. No.: 415,320

[22] Filed: Sep. 7, 1982

[51] Int. Cl.[3] ..... E02F 5/00

[52] U.S. Cl. ..... 37/54; 37/71; 37/195; 37/DIG. 8; 60/721

[58] Field of Search ..... 37/DIG. 8, 54, 58, 71, 37/72, 195

[56] References Cited

U.S. PATENT DOCUMENTS

| | | | |
|---|---|---|---|
| 3,629,963 | 12/1971 | Itami | 37/54 |
| 4,010,560 | 3/1977 | Diggs | 37/DIG. 8 |
| 4,231,171 | 11/1980 | Balligand et al. | 37/DIG. 8 |
| 4,340,970 | 7/1982 | Weinert | 376/208 |
| 4,398,362 | 8/1983 | Weinert | 37/66 X |

*Primary Examiner*—Clifford D. Crowder

[57] ABSTRACT

An oceanic mining system. A sea bulldozer is movable across the bottom of the ocean by means of driven wheels to scrape up sediment from the ocean floor. The wheels are driven by an engine of the type which uses electrolysis to convert sea water into hydrogen and oxygen and then ignites the hydrogen and oxygen to provide power for driving the engine output. A mobile material transporting platform has a loading edge for receiving sediment from the bulldozer. The mobile platform is raised to the surface of the ocean and lowered to the bottom by a cable and winch system mounted on at least one ship with the cables attached to the platform. A cargo ship receives material from the platform. The cargo ship having a material receiving opening. Cable and winch are provided in the cargo ship with the cable attached to the end of the platform opposite the loading edge for maneuvering the loading edge of the platform into operative relationship with the opening for dumping the material into the cargo ship. The bulldozer is remotely controlled from a ship by means of cables to supply power needed for operation.

4 Claims, 7 Drawing Figures

FIG. 3
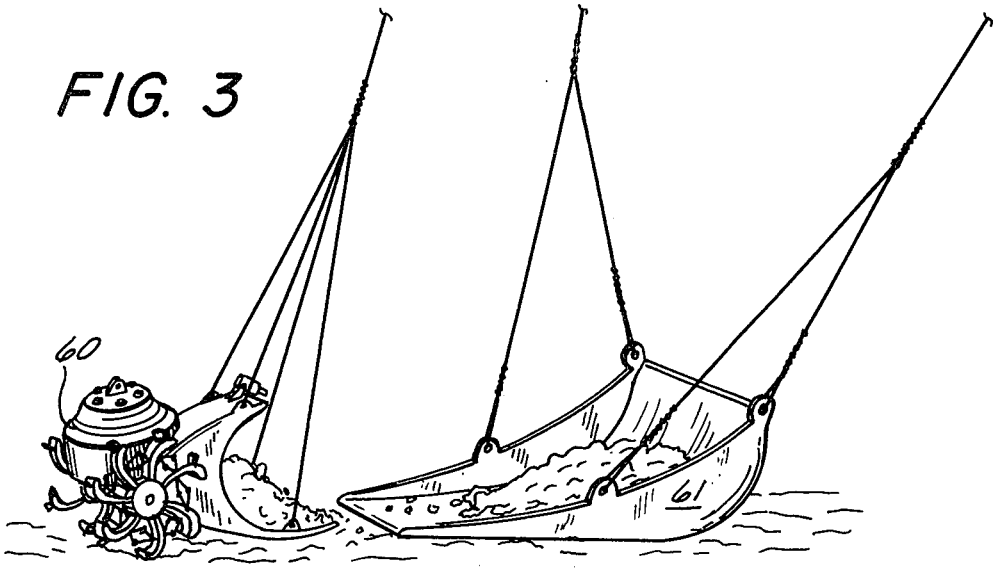
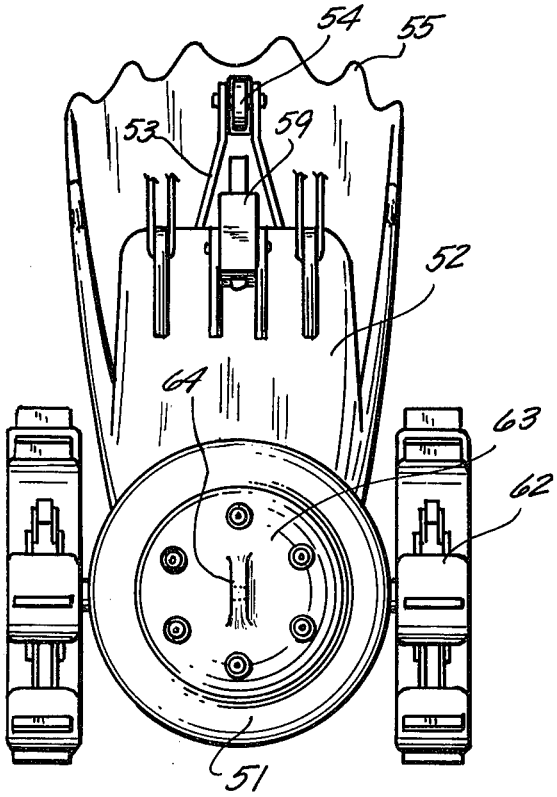
FIG. 4

FIG. 5
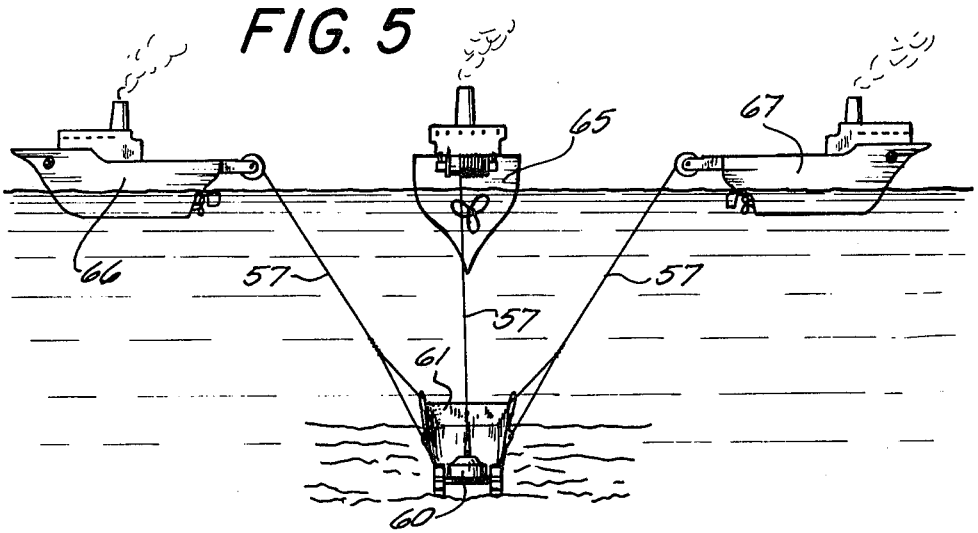
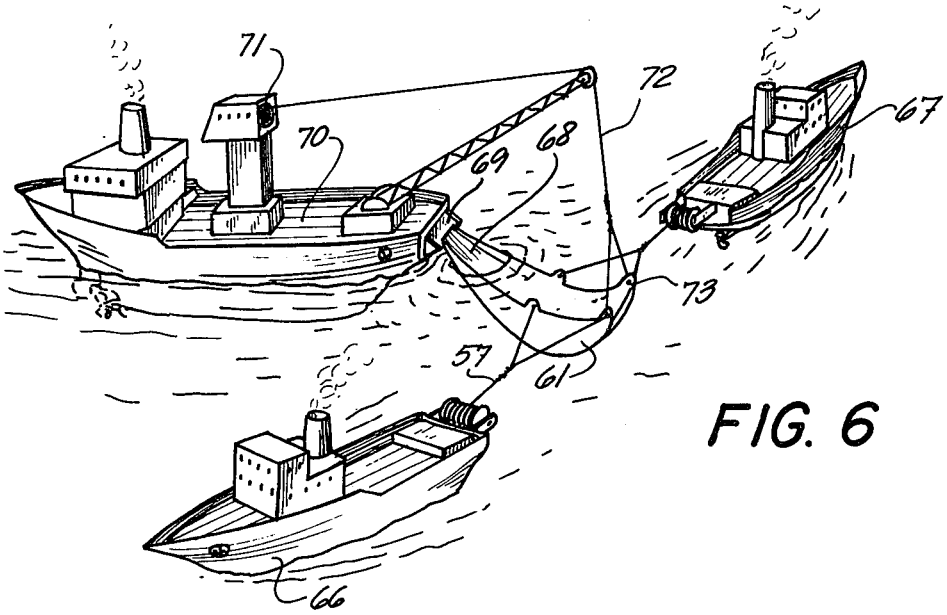
FIG. 6
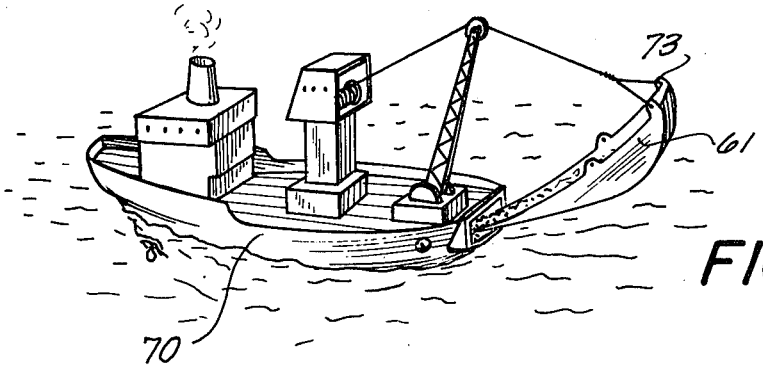
FIG. 7

OCEANIC MINING SYSTEM

TECHNICAL FIELD

This invention relates to oceanic mining means and in particular to such means comprising a sea bulldozer driven by a novel engine.

BACKGROUND ART

This invention introduces a new approach in oceanic mining made possible by a new engine called Power Wheel with double action valves. The engine can operate under any pressure since no hollow space exists, without being pressurized from the surrounding sea water. The work impulse of the engine is introduced through electrolysis whereby diverted oxygen and hydrogen gases become ignited in intervals in order to pressurize sea water trapped inside the engine vessel in such a way that the expansion of the gases move pistons against relaxed stage of the surrounding sea, whereby a series of spindle shafts are rotated intermeshing through pinion gears to a side gear which is fixed to a power shaft to do mechanical work. This means the sea itself becomes the medium as electric power stimulates the medium by electrolysis to introduce a new theromodynamic cycle whereby pistons are moved through the volume exchange of the working fluid which is the sea itself. The principle of this machine is introduced in four different patent applications from the same inventor:

1. Power Wheel U.S. Pat. No. 4,340,970
2. Multiple Power Wheel No. 06/345,720
3. Compact Spindle Drive Ser. No. 06/278,415
4. Multiple Spindle Drive Ser. No. 06/292,510

These inventions mentioned above are activated by a working fluid which recycles the system whereby energy is needed to pump the fluid back into the pressure cell. The present invention does not recycle the working fluid since the surrounded sea water is in abundance and therefore, this invention surpasses the efficiency of the previous inventions. The arguments regarding corrosion are easy to solve. This machine operates on slow moving parts without a dead center so very little heat of any is created by friction and, therefore, can be kept on a permanent idling speed, so the sea itself becomes the ideal lubricant and cooling agent. This means this invention is the only machine able to challenge nature in the most hostile environment, the deep sea, where life can no more exist, but this invention of mine improves by confronting dynamic forces at its best. I have a simpler digger device with a flexible hose with air injections from above the sea level which can do better than all the high sophisticated methods which relate more to space exploration than oceanic mining. In large scale, oceanic mining becomes even more economical than land mining. This is the principle of the present invention which includes a mobile platform in form of a giant shovel without a handle which can be raised or lowered to the ocean floors by means of cables connected to one or more ships. As the platform is put on the ocean floor a separate ship called Bulldozer Ship lowers a sea bulldozer by cables to the sea floor in front of the platform. The sea bulldozer is remotely controlled from the bulldozer ship to move the bulldozer back or forward. The bulldozer is activated by a horizontal power wheel with double action valves or related designs. The bulldozer will fill the platform by moving back and forward to scrape the ocean floor on to the platform. When the platform is loaded the ships attached to the platform by means of cables will raise the platform close to the surface. In this position the platform is tilted towards the heavy end so the loading edge will penetrate the water surface so the loading edge can be joined to an opening to a cargo ship. The cargo ship hooks up a cable at the lower end of the platform which ables the cargo ship to raise the platform out from the sea at an angle to force the contents of the platform to slide into the cargo space of the cargo vessel. When the platform is relieved of its contents, it will be lowered back to the sea floor to repeat the same process as explained above. The time needed to raise or lower the platform gives the cargo ship time enough to process the minerals. In this fashion a very efficient and practical oceanic mining system is introduced by a mobile platform, a remote controlled sea bulldozer and a cargo ship able to unload the platform at once by raising the platform above sea level.

SUMMARY OF THE INVENTION

In accordance with the invention there is provided a oceanic mining system which includes a mobile platform attached to ships by means with cables to be raised or lowered to the sea floor. A bulldozer is connected by cables to a separate ship or submarine in order to move backwards or forwards on the sea floor to scrape the sea floor on to the platform which when loaded is raised below the sea level in such a fashion that only the loading edge penetrates the sea level and therefore can be joined into an opening of a cargo ship which will hook up a separate cable to the lower end of the platform to be able to raise the platform with its contents above sea level in an angle to allow contents on the platform to slide into the cargo space of the cargo ship. When the platform is unloaded, the platform is again lowered to the sea floor as explained in the background of the invention. The operation of this system is depending on the performance of the sea bulldozer. Therefore, special wheels and a special engine is chosen. The wheel consists of a wheel hub with a curved flexible spokes interlinked to each other by a double hinge device which allows the wheel spokes to move in between the hinge play. The benefit obtained is, that each individual wheel spoke can sink into the mud up to the hinge and therefore achieve a solid grip even on a soft ground. The scraper bucket is joined to the wheel axle at the rear end of the bucket. The front edge which does the scraping is supported by a surface wheel to prevent front edge to penetrate too deep into the ocean floor. The bulldozer has an electric gear shift to move the bulldozer forward to the right or left in neutral or reverse, the bucket cannot be raised or lowered by the bulldozer. This is done from the assistant ship which is attached to the bulldozer by cables, rolled over a winch. The movement of the vessel or submarine attached to the bulldozer can also assist the back and forward motion of the bulldozer. The engine of the bulldozer comes in different designs as indicated in the background of the invention.

OBJECTS OF THE INVENTION

A principal object of the invention is to provide a new and improved oceanic mining means.

Another object of the invention is to provide a new and improved oceanic mining system comprising of a sea bulldozer movable across the bottom of the ocean by means of driven wheels to scrape up sediment from the ocean floor, said wheels being driven by an engine of the type which uses electrolysis to convert sea water into hydrogen and oxygen and then ignites the hydrogen and oxygen to provide power for driving the engine output, a mobile material transporting platform having a loading edge for receiving sediment from the bulldozer, means to raise the mobile platform to the surface of the ocean and lower it to the bottom including a cable and winch system mounted on at least one ship with the cables attached to the platform, a cargo ship for receiving material from the platform, said cargo ship having a material receiving opening, cable and winch means on said cargo ship with the cable attached to the end of the platform opposite the loading edge for maneuvering said loading edge of said platform into cooperative relationship with said opening for dumping said material into said cargo ship, said bulldozer being remotely controlled from a ship by means of cables to supply power needed for operation thereof.

Further objects of this invention will be pointed out in the following detailed description and claims and illustrated in the accompanying drawing which disclosed by way of example the principal of this invention and the best mode which has been contemplated of applying that principal.

BRIEF DESCRIPTION OF THE DRAWING

FIG. 3 is a perspective view of a sea bulldozer loading a platform.

FIG. 4 is a perspective rear view of a sea bulldozer of this invention.

FIG. 5 is an explanatory plan view of the oceanic mining system.

FIG. 6 is a perspective explanatory view of the ocean mining system consisting of three ships and one mobile platform.

FIG. 7 is a perspective view of the cargo ship unloading a mobile platform.

DETAILED DESCRIPTION OF A PREFERRED EMBODIMENT

Figure 1:
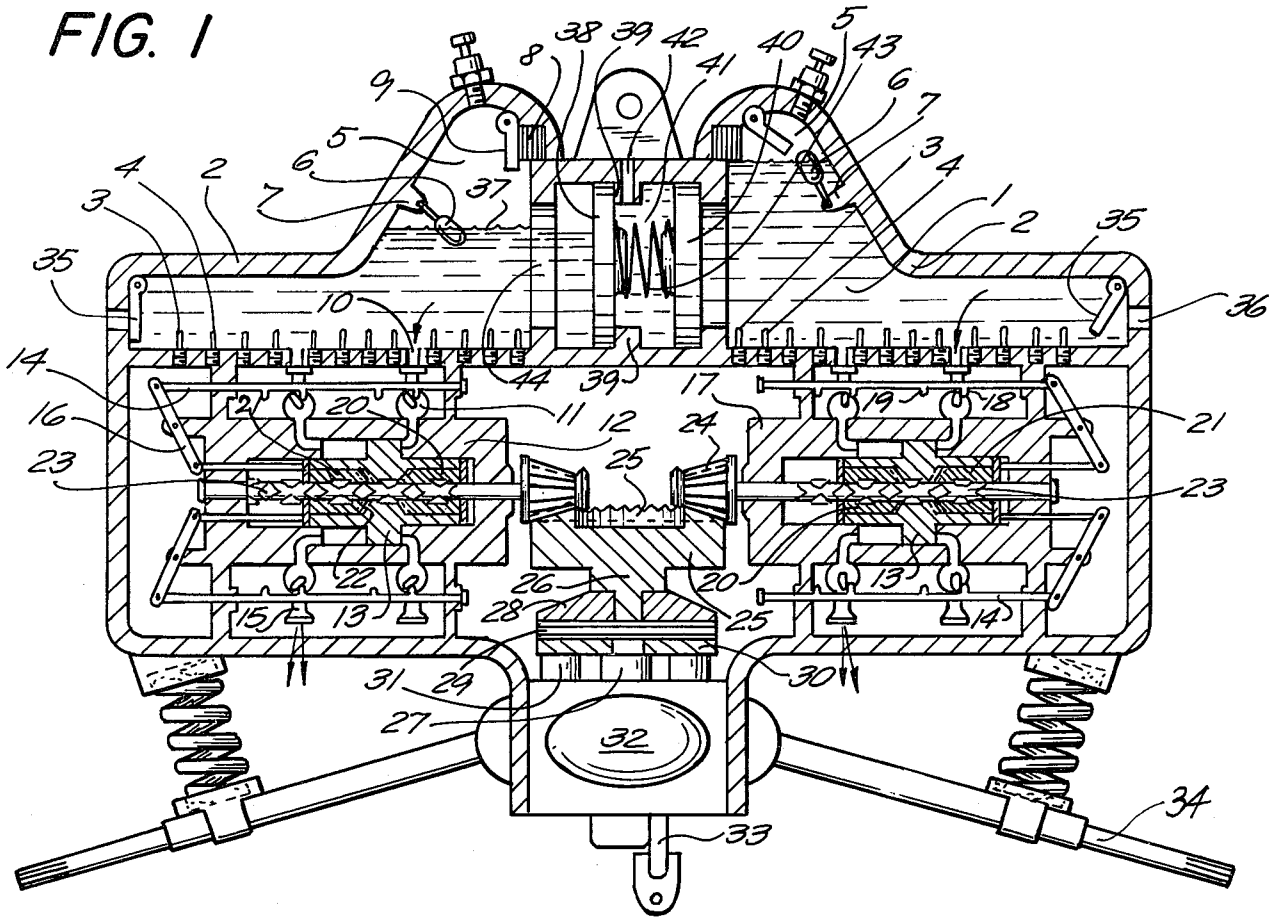
FIG. 1 is a partly sectional explanatory view of a horizontal power wheel with double action valves used as a prime mover for a sea bulldozer.

In accordance with the invention there is provided an oceanic mining system which includes a mobile platform attached by cables to one or more ships, a sea bulldozer attached by cables to a separate ship as shown in FIG. 5. FIG. 1 shows an engine most practical to operate sea bulldozer. The engine is already patent pending entitled "Power Wheel with Double Action Valves", Serial Number 405,310. The difference between the pending power wheel with double action valves and the present invention is that the existing working fluid is not recycled since the working fluid consists of the surrounding sea water. This introduces a new thermodynamic cycle whereby sea water FIG. 1(1) is trapped in fluid vessel (2) and pressurized through electrolysis introduced through anode (3) and cathode (4) by separating the sea water into its basic elements of oxygen and hydrogen which accumulates in pressure dome (5). The raising fluid level (37) inside fluid vessel (2) will lift float (6) from float valve switch (7) which automatically will close the electric circuit to activate electromagnet (8) which in return will attract igniter flap valve (9) in such a force that pressurized hydrogen trapped in between the surface of the flap valve and the magnet will ignite and, therefore pressurizing the fluid or sea water in fluid vessel (10) into inlet valve (11) of the spindle drive mechanism (12) which moves piston (13) strokewise in one direction which activates valve control bar (14) to change sequentially inlet and outlet valve position. FIG. 1 left side shows inlet valve (11) on open position and outlet valve (15) on open position as the other inlet and outlet valves are in closed position. This will move piston (13) to the left which automatically move valve lever (16) outward which moves valve control bar inward as shown on the right side in FIG. 1. This will revese the flow of the sea water in one direction, meaning the left spindle drive mechanism moves piston (13) from the right to the left. The right spindle drive mechanism (17) moves piston (13) from the right to the left made possible through stopper unit (18) or (19) which changes valve position by the movement of the piston so piston can be moved in either direction. The stroke action of the piston engages and disengages one pawl bushing at a time. The left spindle drive mechanism (12) engages pawl bushing (20) as pawl bushing (21) disengages right spindle drive mechanism (17). All pawl bushings confronting piston flange (22) intermeshing through a ratchet gear which is explained in details in a previous patent application called power wheel with double action valves Ser. No. 405,310. Each pair of pawl bushings are grooved in opposite directions so each stroke of piston (13) will engage one pawl bushing at a time which will rotate spindle shaft (23) in one direction made possible by haing spindle shaft machined with a right and left spindle track as the pawl bushings also are machined with a right or left track shoe. The rotation of the spindle shaft will rotate pinion gear (24) which is intermeshing with side gear (25) to rotate power shaft (26) which is joined to drive shaft (27) by a clutch consisting of a pressure plate (28) which looks clutch disc (29) against flange disc (30). The pressure used to engage or disengage the clutch disc (29) is achieved by a hydraulic piston (31). The drive shaft (27) will activate gear box (32) which can engage different gears through shift lever (33) which will engage wheel axle (34). There is no differential gear needed. As explained above the surrounding sea water is used as the working fluid, meaning when fluid vessel (2) as shown in FIG. 1 at the right side, has reached relaxed stage flap valve (35) will open to allow the surrounding sea water to enter through sea water channel (36) to fill up vessel (2) which automatically puts float valve (7) in off position. Anode (3), cathode (4) are always in action to separate the basic elements of the sea water in form of oxygen and hydrogen gases which fill the upper space of pressure dome (5) till the water level (37) lowers itself deep enough to activate float valve switch (7) by lowering float (6) which automatically activates electromagnet (8) to attract flap valve (9) which will ignite pressurized gases in pressure dome (5). The fluid vessel (2) is divided in sections, one section for each spindle drive mechanism. Therefore, a plurality of spindle drives intermeshing with side gear (25) in different timings can produce a steady torque to rotate power shaft (26) to do practical work. During the explosion of the compressed gases in pressure dome (5) the expansion of the gases will move buffer piston (38) outward against stopper unit (39) which automatically moves duplex piston (40) against the working fluid (1). This is a safety precaution acting like a safety valve whereby sea water trapped in between piston (38) and (40) act like a buffer zone (41) by releasing excess pressure through opening (42). Spring (43) acting as a safety valve by moving piston (38) and (40) against open flange (44) meaning both pistons (38) and (40) increasing the space inside the fluid vessel (2) they will automatically close flap valve (35).

Figure 2:
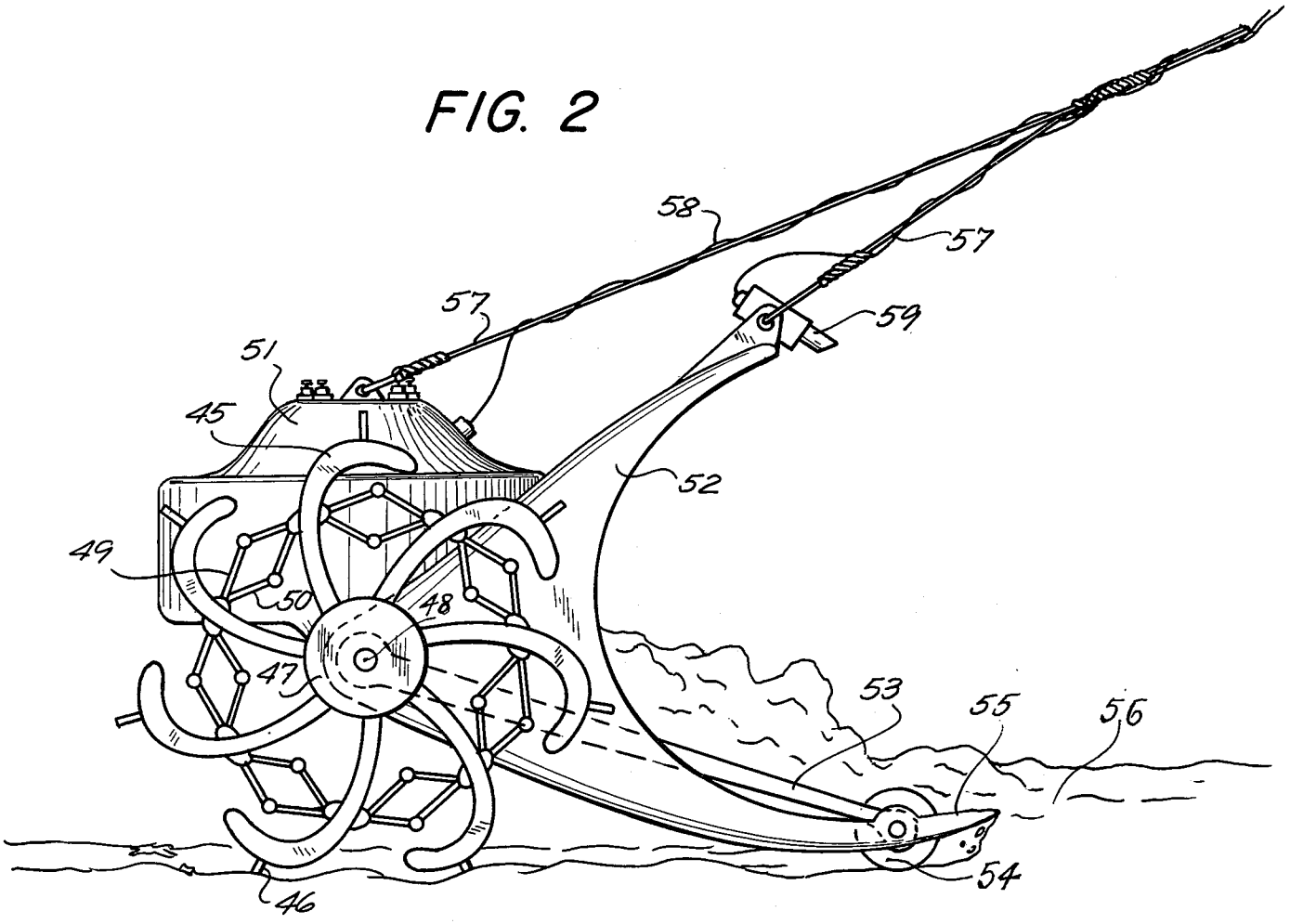
FIG. 2 is a side view of the sea bulldozer.

FIG. 2 shows a sea bulldozer in operation on the ocean floor. The bulldozer moves on flexible wheels consisting of flexible spokes (45) which are curved at the very end to which outer circumference a track bar (46) is installed. The wheel spokes (45) are anchored into wheel hub (47) which is centralized to wheel axis. The wheel spokes are also anchored to each other by a left hinge (49) and right hinge (50). The hinges prevent the wheel against sinking in the mud and at the same time allow the wheel spokes to move in between the play of the hinges to move against or from each other which gives the wheel a better traction increased through track bar (46). The prime mover (51) is installed on top of wheel axel and fixed against bucket (52) supported by frame (53) which supports track wheel (54) in order to prevent cutting edge FIG. 4 (55) to penetrate too deep into the ocean floor. The bulldozer is attached to a ship or submarine by cables FIG. 2 (57) and electric cable (58). The electric cable supplying electricity for electrolysis, clutch, gear shift and controls for under water TV camera (59).

FIG. 3 shows a sea bulldozer (60) in action loading platform (61).

FIG. 4 shows a rear top perspective view to indicate flexible wheels (62) and prime mover (51) bucket (52) showing clearly cutting edge (55) and track wheel (54) TV camera (59) dome (63) of fluid vessel and hook eyelet (64).

FIG. 5 shows an explanatory view of the entire operation. Seaplow (60) moves against mobile platform (61) assisted by working ship (65) and cables (57). Two separate ships (66) and (67) raising or lowering platform (61) through cables (57) as needed.

FIG. 6 is an explanatory perspective view indicating assistant ship (66) and (67) raising platform (61) to connect loading edge (68) into opening (69) of cargo ship (70). At this point the cargo vessel will activate winch to roll up cable (72) which is connected at the lower end (73) of platform (61). This will raise as shown in FIG. 7 platform (61) above sea level so the contents on the platform can slide into the cargo space of cargo ship (70). After the releasing the contents from the platform the platform again is lowered to the ocean floor for mining purposes as the cargo ship is processing the contents. While there have been shown and described and pointed out the fundamental features of the invention as applied to a preferred embodiment, it will be understood that various omissions and substitutions and changes in the form and detail of the oceanic mining system as illustrated in its detail may be made by those skilled in the art without departing from spirit of the invention.

It is claimed:

1. An oceanic mining system comprising a sea bulldozer movable across the bottom of the ocean by means of driven wheel to scrape up sediment from the ocean floor, said wheels being driven by an engine of the type which uses electrolysis to convert sea water into hydrogen and oxygen and then ignites the hydrogen and oxygen to provide power for driving the engine output, a mobile material transporting platform having a loading edge for receiving sediment from the bulldozer, means to raise the mobile platform to the surface of the ocean and lower it to the bottom including a cable and winch system mounted on at least one ship with the cables attached to the platform, a cargo ship for receiving material from the platform, said cargo ship having a material receiving opening, cable and winch means on said cargo ship with the cable attached to the end of the platform opposite the loading edge for maneuvering said loading edge of said platform into cooperative relationship with said opening for dumping said material into said cargo ship, said bulldozer being remotely controlled from a ship by means of cables to supply power needed for operation thereof.

2. Apparatus as in claim 1, said wheels each having a plurality of curved flexible bars installed around the circumference of a wheel hub, wherein the bars are connected to each other by upper and lower hinges installed between two wheel spokes to prevent the wheel from sinking below the hinges.

3. The combination as claimed in claim 2, in which the sea bulldozer is capable of moving backward or forward and includes a frame mounting the engine with a scraper bucket having a cutting edge fixed on the frame, and a track wheel mounted below the cutting edge of bucket to prevent the cutting edge from cutting too deep into the sea floor.

4. Apparatus as in claim 3, in which the sea bulldozer is remotely controlled by a surface vessel or submarine by means of cables connected to activate the bulldozer on the ocean floor.

* * * * *